US005283397A

United States Patent [19]

Pavlovic

[11] Patent Number: 5,283,397

[45] Date of Patent: Feb. 1, 1994

[54] DIAPHRAGM FOR ELECTRODYNAMIC TRANSDUCER

[75] Inventor: Dino Pavlovic, Vienna, Austria

[73] Assignee: AKG Akustische u. Kino-Geräte Gesellschaft m.b.H., Vienna, Austria

[21] Appl. No.: 951,583

[22] Filed: Sep. 25, 1992

[30] Foreign Application Priority Data

Sep. 25, 1991 [AT] Austria ..... 1932/91

[51] Int. Cl.[5] ..... G10K 13/00

[52] U.S. Cl. ..... 181/163; 181/165

[58] Field of Search ..... 181/152, 154, 159, 163, 181/164, 165, 168, 169, 173

[56] References Cited

U.S. PATENT DOCUMENTS

| | | | |
|---|---|---|---|
| 2,845,135 | 7/1958 | Cohen et al. | 181/152 |
| 2,852,089 | 9/1958 | Cohen et al. | 181/152 |
| 3,940,576 | 2/1976 | Schultz | 181/152 |
| 4,122,315 | 10/1978 | Schroeder et al. | 181/147 |
| 4,132,872 | 1/1979 | Inoue | 181/165 X |

FOREIGN PATENT DOCUMENTS

| | | |
|---|---|---|
| 382281B | 2/1987 | Austria . |
| 1092061 | 11/1960 | Fed. Rep. of Germany . |
| 596869 | 2/1948 | United Kingdom . |

*Primary Examiner*—Michael L. Gellner
*Assistant Examiner*—Khanh Dang
*Attorney, Agent, or Firm*—Feiereisen & Kueffner

[57] ABSTRACT

A diaphragm with moving coil for electrodynamic transducers has in the center thereof a spherically-shaped portion and adjacent to the spherically-shaped portion a toroidally-shaped zone which may be provided with corrugations. An outwardly diverging, truncated cone-shaped collar is placed on the spherically-shaped portion. The collar may be of the same material as the diaphragm. The collar has a circular rim which is mechanically fixedly connected to the spherically-shaped portion. The circular rim of the collar has a smaller diameter than the moving coil.

6 Claims, 1 Drawing Sheet

DIAPHRAGM FOR ELECTRODYNAMIC TRANSDUCER

BACKGROUND OF THE INVENTION

1. Field of the Invention

The present invention relates to a diaphragm with moving coil for an electrodynamic transducer. The diaphragm has in its center a spherically-shaped portion. A toroidally-shaped zone extending to the diaphragm edge is provided adjacent the spherically-shaped portion. The toroidally-shaped zone may be provided with corrugations.

2. Description of the Related Art

A diaphragm of the above-described type is used successfully in sound generators and sound receivers.

In the ideal case, a diaphragm of the above type should have the vibration behavior of a piston, so that vibration properties are obtained which are very similar to those of the spherical source of the 0th order. Accordingly, when manufacturing such a diaphragm, it is a particular object to realize this ideal case as closely as possible by the special selection of material and shape of the diaphragm.

Experience has shown that the vibration behavior of a diaphragm including a moving coil mass is characterized at higher frequencies of the transmission range of 20 kHz and above in that with increasing frequency the sensitivity of the electrodynamic transducer decreases steadily, wherein periodic fluctuations in the frequency pattern are observed in this frequency range. In the frequency range above approximately 5 to 8 kHz, the perception of the observer is that with increasing frequency the acoustically effective diaphragm surface area decreases continuously. This phenomenon is already mentioned in Austrian Patent 382 281.

It is well known that the deteriorating vibration behavior of the diaphragm at higher frequencies is due to the increase of effects caused in the diaphragm by flexural or bending waves. DE-AS 10 92 061 describes in detail how this type of natural vibrations can be eliminated in conical diaphragms.

Also, in dynamic transducers with a diaphragm of the above-described type it was attempted in the past to compensate as much as possible the loss of sensitivity occurring at high frequencies by utilizing a Helmholtz resonator. For this purpose, the natural resonance and quality of the resonator must be selected in such a way that the desired frequency pattern of the transducer is actually achieved. This was not always successful because it was not always possible to establish the band width and quality of the resonator to the extent required for an optimum compensation. Compromises had to be accepted or two-way systems had to be used.

Another proposal for improving the vibration behavior of diaphragms at higher and high frequencies can be found in British Patent No. 596 869. This proposal either refers to a sandwich-like coating of the diaphragm with a stiffening material or an embossment of the diaphragm with appropriate patterns to obtain a stiffening effect. However, these improvements are essentially only applicable to diaphragms having a certain shape and are not necessarily transferable to any type of diaphragm.

SUMMARY OF THE INVENTION

Therefore, it is an object of the present invention, in a diaphragm for electrodynamic transducers with a moving coil and a spherically-shaped portion in the diaphragm center, to provide suitable measures for obtaining a vibration behavior at high frequencies which leads to a virtually constant sensitivity of the transducer and, in addition, for avoiding wave-shaped fluctuations in the frequency pattern of the transducer.

In accordance with the present invention, the spherically-shaped portion of the diaphragm of the above-described type is provided with an outwardly diverging, truncated cone-shaped collar or web which is preferably of the same material as the diaphragm. The truncated cone-shaped collar has a circular rim which is mechanically fixedly connected to the spherically-shaped portion and has a smaller diameter than the moving coil.

The fixed mechanical connection of the cone-shaped collar results in an elimination of the flexural waves on the surface of the spherically-shaped portion within the periphery of the collar. In addition, the surface of the collar increases the surface area which participates acoustically in the vibration of the diaphragm.

Tests have shown that a cone-shaped collar which has the same diameter as the moving coil did not result in any change of the frequency pattern of the transducer. Accordingly, in order to obtain an effective result, it is a very important feature of the present invention to construct the diameter of the collar smaller than the diameter of the moving coil. Also, the diameter of the collar determines to a very significant extent the uppermost frequency limit of the transmission range which can be achieved, wherein a smaller diameter results in a higher limiting frequency.

In practical use, the optimum diameter will have to be determined by the requirements made of the frequency response of the transducer. While the height of the collar determines the size of the additionally radiating surface area, it will be attempted to keep this height as small as possible in order, on the one hand, to prevent possible flexural waves on the conical collar and, on the other hand, to prevent the mass from becoming too large, so that the attendant inevitable decrease of sensitivity stays within acceptable limits and generally does not exceed a loss of, for example, 1 dB.

The effect obtained in the diaphragm according to the present invention is exclusively a result of the configuration of the cone-shaped collar and the fixed mechanical connection of the collar to the spherical portion of the diaphragm. An assumption that the cone-shaped collar could provide a better acoustic adaptation of the diaphragm to the surrounding medium is incorrect because, in the frequency range under consideration, the existing diameter of the spherically-shaped portion already provides an adaptation to the air wave resistance.

The aperture angle of the cone-shaped collar has a lesser influence on the highest frequency to be transmitted. The decisive aspect is only the surface increase of the diaphragm obtained by the cone-shaped collar.

The most important advantage of the diaphragm according to the present invention is the fact that it is no longer necessary to provide the previously absolutely required Helmholtz resonator, so that there is greater flexibility in the structural design of the housing which protects the transducer.

In accordance with an advantageous further development of the invention, the truncated cone-shaped collar is of a material which differs from the material of the diaphragm. For example, the collar is of metal foil, paper or the like.

The use of metal foil or paper for the truncated cone-shaped collar is advantageous because it results in an improved effect of the diaphragm according to the present invention and it favorably influences the flexural waves and the mass which is additionally added to the mass of the diaphragm.

In accordance with another advantageous feature of the present invention, the truncated cone-shaped collar is connected with its circular rim mechanically fixedly to the spherically-shaped portion of the diaphragm by gluing, ultrasonic welding or the like.

A fixed connection of the collar placed on the spherically-shaped portion of the diaphragm is indispensable for ensuring that the movements of the collar conform to the movements of the spherically-shaped portion of the diaphragm and to prevent the collar from being excited to natural vibrations at higher frequencies. In addition, the purpose of the circular fastening zone of the collar on the spherically-shaped portion is to obtain a first line of discontinuity for flexural waves which simultaneously also keeps flexural waves away from the region within the circular connection between collar and spherically-shaped portion. A fixed mechanical connection of both parts which can be particularly realized by appropriate gluing or ultrasonic welding is required for this purpose.

However, other types of connections, such as, thermoplastic fusion or hot sealing are conceivable.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE PREFERRED EMBODIMENT

Figure 1:
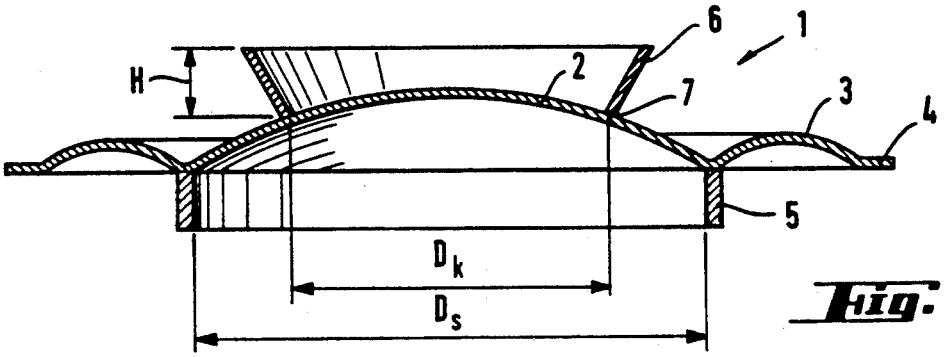
FIG. 1 is a schematic sectional view of a diagram according to the present invention with a truncated cone-shaped collar placed on a spherically-shaped portion of the diaphragm.

FIG. 1 of the drawings shows a diaphragm 1 for an electrodynamic transducer. As is conventional, the diaphragm 1 includes a preferably cylindrical moving coil 5 and a spherically shaped portion 2 in the center of the diaphragm 1, as well as a preferably annular toroidally-shaped zone 3 provided adjacent the diaphragm edge 4.

In accordance with the present invention, an outwardly diverging, truncated cone-shaped collar 6 is mounted on the spherically-shaped portion 2 by means of a fixed mechanical connection along the circular rim 7. The diameter $D_k$ of the collar 6 is smaller than the diameter $D_s$ of the moving coil 5. The collar 6 has a height H which determines the size of the additionally radiating surface.

The configuration of the diaphragm 1 with the collar 6 according to the present invention results in a substantial improvement of the frequency pattern of the electrodynamic transducer at high frequencies.

Figure 2:
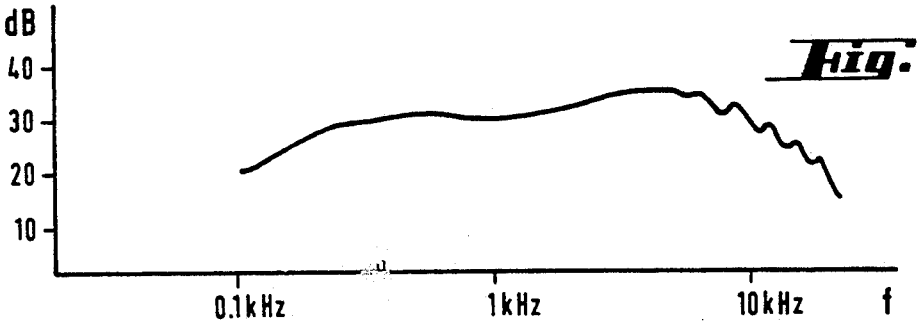
FIG. 2 is a diagram showing the frequency pattern of electrodynamic transducer with a conventional diaphragm.

FIG. 2 illustrates the frequency pattern of a conventional diaphragm. As can be seen in FIG. 2, the frequency pattern of the conventional diaphragm is characterized in the range of high frequency by a steady drop in sensitivity, wherein the periodic waviness of the curve clearly shows the influence of the flexural waves forming on the diaphragm.

By providing the truncated cone-shaped collar 6 in accordance with the present invention, a marked improvement of the frequency pattern of the transducer at high frequencies is obtained, wherein the improvement is not only to be seen in the continuity of the sensitivity, but also in the decrease of the effect resulting from flexural waves.

Figure 4:
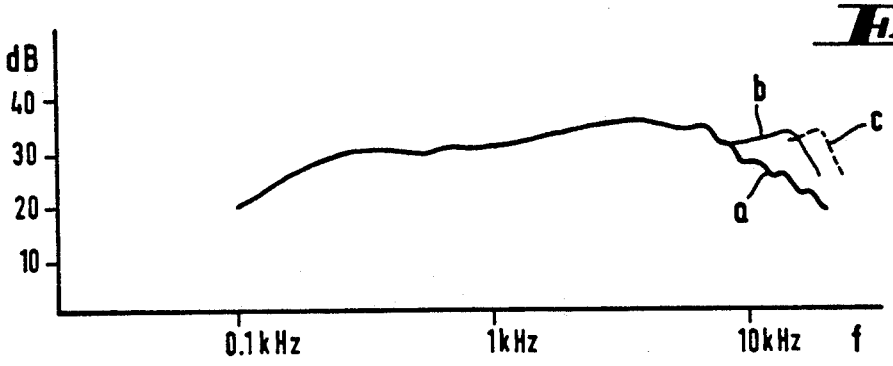
FIG. 4 is a diagram showing the frequency pattern of an electrodynamic transducer having the diaphragm according to the present invention.

The marked improvement referred to above is illustrated in FIG. 4. In FIG. 4, curve a shows again the frequency pattern of a transducer with a conventional diaphragm. On the other hand, curves b and c show the frequency pattern in a diaphragm according to the present invention. Curves b and c are shown to emphasize the fact that the diameter $D_k$ of the rim of the collar 6 resting on the spherically-shaped portion 2 is important for the uppermost frequency limit of the transmission range to be achieved. Thus, as already mentioned, a smaller diameter results in an expansion of the range which is higher in its frequency, which is shown by curve c. Curves b and c further demonstrate that in the range of high frequencies it is no longer necessary to provide a Helmholtz resonator for raising the curve.

Figure 3:
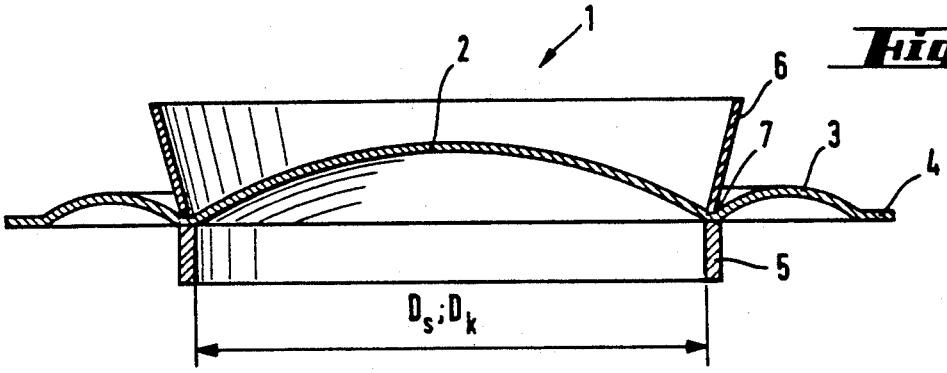
FIG. 3 is a schematic sectional view of a diaphragm in which collar and moving coil have the same diameter.

Finally, FIG. 3 of the drawing shows an embodiment in which the radius of the moving coil and the radius of the collar are the same. As already mentioned above, this configuration does not result in a provable effect because, even though the radiation surface area of the diaphragm is increased, the cancellation effect caused by flexural waves predominates. This area of the diaphragm in which the moving coil is fixedly glued to the diaphragm must be considered an excitation center for the flexural waves. Thus, an arrangement of the collar on the diaphragm as shown in FIG. 3 results in a frequency pattern of the transducer shown in FIG. 2.

In accordance with the invention, shapes of the diaphragm other than a circular shape are conceivable, for example, those having an oval or rectangular edge. Also, the moving coil does not have to be a cylinder with a circular cross-section. However, a coil having an oval or rectangular cross-section is also conceivable. However, these different shapes are not illustrated in detail in the drawing because, although these different shapes widen the scope of the present invention, they do not affect the principal solution provided in accordance with the present invention.

It should be understood that the preferred embodiments and examples described are for illustrative purposes only and are not to be construed as limiting the scope of the present invention which is properly delineated only in the appended claims.

What is claimed is:

1. In a diaphragm for electrodynamic transducers, the diaphragm having a center and an edge, the diaphragm including a spherically-shaped portion in the center thereof and toroidally-shaped portion adjacent the spherically-shaped portion extending to the edge of the diaphragm, a moving coil connected to the spherically shaped portion of the diaphragm, the improvement comprising an outwardly diverging, truncated cone-shaped collar mounted on the spherically-shaped portion, the truncated cone-shaped collar having a circular rim, the circular rim being mechanically fixedly connected to the spherically-shaped portion, wherein the moving coil and the circular rim each have a diameter, wherein the diameter of the circular rim of the collar is smaller than the diameter of the moving coil.

2. The diaphragm according to claim 1, wherein the toroidally-shaped zone is corrugated.

3. The diaphragm according to claim 1, wherein the truncated cone-shaped collar and the spherically-shaped portion and the toroidally-shaped portion of the diaphragm are of the same material.

4. The diaphragm according to claim 1, wherein the truncated cone-shaped collar and the spherically-shaped portion and the toroidally-shaped portion of the diaphragm are of different materials.

5. The diaphragm according to claim 4, wherein the material of the truncated cone-shaped collar is metal foil or paper

6. The diaphragm according to claim 1, wherein the circular rim of the truncated cone-shaped collar is mechanically fixedly connected to the spherically-shaped portion of the diaphragm by a glued connection or an ultrasonically welded connection.

* * * * *